US010319387B2

(12) United States Patent
Schmidt et al.

(10) Patent No.: US 10,319,387 B2
(45) Date of Patent: Jun. 11, 2019

(54) ENCODER FOR ENCODING AN AUDIO SIGNAL, AUDIO TRANSMISSION SYSTEM AND METHOD FOR DETERMINING CORRECTION VALUES

(71) Applicant: Fraunhofer-Gesellschaft zur Foerderung der angewandten Forschung e.V., Munich (DE)

(72) Inventors: Konstantin Schmidt, Nuremberg (DE); Guillaume Fuchs, Bubenreuth (DE); Matthias Neusinger, Rohr (DE); Martin Dietz, Nuremberg (DE)

(73) Assignee: Fraunhofer-Gesellschaft zur Foerderung der angewandten Forschng e.V., Munich (DE)

( * ) Notice: Subject to any disclaimer, the term of this patent is extended or adjusted under 35 U.S.C. 154(b) by 0 days.

(21) Appl. No.: 15/644,308

(22) Filed: Jul. 7, 2017

(65) Prior Publication Data

US 2017/0309284 A1 Oct. 26, 2017

Related U.S. Application Data

(60) Division of application No. 15/147,844, filed on May 5, 2016, now Pat. No. 9,818,420, which is a (Continued)

(30) Foreign Application Priority Data

Nov. 13, 2013 (EP) ..... 13192735
Jul. 28, 2014 (EP) ..... 14178815

(51) Int. Cl.
*G10L 19/16* (2013.01)
*G10L 19/038* (2013.01)
*G10L 19/06* (2013.01)

(52) U.S. Cl.
CPC ..... *G10L 19/167* (2013.01); *G10L 19/038* (2013.01); *G10L 19/06* (2013.01)

(58) Field of Classification Search
CPC ..... G10L 19/167
(Continued)

(56) References Cited

U.S. PATENT DOCUMENTS 5,233,659 A 8/1993 Ahlberg
8,117,027 B2 2/2012 Neubauer et al.
(Continued)

FOREIGN PATENT DOCUMENTS

JP H764599 A 3/1995
KR 1020120039865 A 4/2012
(Continued)

OTHER PUBLICATIONS

Bouzid, M. et al., "Optimized Trellis Coded Vector Quantization of LSF Parameters Application to the 4.8kbps FS1016 Speech Coder", Signal Processing, Elsevier Science Publishers B.V. Amsterdam, NL, vol. 85, No. 9, Sep. 1, 2005, pp. 1675-7694.
(Continued)

*Primary Examiner* — Susan I McFadden
(74) *Attorney, Agent, or Firm* — Perkins Coie LLP; Michael A. Glenn

(57) ABSTRACT

An encoder for encoding an audio signal includes an analyzer for analyzing the audio signal and for determining analysis prediction coefficients from the audio signal. The encoder includes a converter for deriving converted prediction coefficients from the analysis prediction coefficients, a memory for storing a multitude of correction values and a calculator. The calculator includes a processor for processing the converted prediction coefficients to obtain spectral weighting factors. The calculator includes a combiner for combining the spectral weighting factors and the multitude
(Continued)

of correction values to obtain corrected weighting factors. A quantizer of the calculator is configured for quantizing the converted prediction coefficients using the corrected weighting factors to obtain a quantized representation of the converted prediction coefficients. The encoder includes a bitstream former for forming an output signal based on the quantized representation of the converted prediction coefficients and based on the audio signal.

4 Claims, 8 Drawing Sheets

Related U.S. Application Data continuation of application No. PCT/EP2014/073960, filed on Nov. 6, 2014.

(58) Field of Classification Search
USPC ..... 704/219
See application file for complete search history.

(56) References Cited

U.S. PATENT DOCUMENTS

| | | | |
|---|---|---|---|
| 8,744,843 | B2 | 6/2014 | Geiger et al. |
| 8,744,863 | B2 | 6/2014 | Neuendorf et al. |
| 9,037,457 | B2 | 5/2015 | Geiger et al. |
| 9,115,883 | B1 | 8/2015 | Martin et al. |
| 9,153,236 | B2 | 10/2015 | Setiawan et al. |
| 9,495,972 | B2 | 11/2016 | Geiger |
| 9,524,724 | B2 | 12/2016 | Disch et al. |
| 9,818,420 | B2 * | 11/2017 | Schmidt ..... G10L 19/167 |
| 2009/0299742 | A1 | 12/2009 | Toman et al. |
| 2010/0169081 | A1 | 7/2010 | Yamanashi et al. |
| 2010/0191534 | A1 | 7/2010 | Ryu et al. |
| 2010/0312553 | A1 | 12/2010 | Fang et al. |
| 2011/0200198 | A1 | 8/2011 | Grill et al. |
| 2011/0295598 | A1 | 12/2011 | Yang et al. |
| 2011/0299702 | A1 | 12/2011 | Faller |
| 2012/0095756 | A1 | 4/2012 | Sung et al. |
| 2012/0253797 | A1 | 10/2012 | Geiger et al. |
| 2013/0204630 | A1 | 8/2013 | Ragot et al. |
| 2014/0343953 | A1 | 11/2014 | Geiger et al. |

FOREIGN PATENT DOCUMENTS

| | | | |
|---|---|---|---|
| RU | 2464650 | C2 | 10/2012 |
| RU | 2483365 | C2 | 5/2013 |
| RU | 2493617 | C2 | 9/2013 |
| TW | 201129967 | A | 9/2011 |
| TW | 201214419 | A | 4/2012 |
| WO | 2010028784 | A1 | 3/2010 |
| WO | 2011048117 | A1 | 4/2011 |
| WO | 2012004349 | A1 | 1/2012 |
| WO | 2012053798 | A2 | 4/2012 |

OTHER PUBLICATIONS

Gardner, R. W. et al., "Theoretical analysis of the high-rate vector quantization of LPC parameters", Speech and Audio Processing, IEEE Transactions on Speech and Audio Processing, vol. 3, No. 5, Sep. 1995, pp. 367-381.

ITU-T, G.718 , "Frame error robust narrow-band and wideband embedded variable bit-rate coding of speech and audio from 8-32 kbit/s", Recommendation ITU-T G.718, Jun. 2008, 257 pages. section 6.8.2.4 ISF weighting function for frame-end ISF quantization.

Laroia, R. et al., "Robust and efficient quantization of speech LSP parameters using structured vector quantizers", Acoustics, Speech, and Signal Processing, 1991. ICASSP-91., 1991 International Conference on, vol. 1, Apr. 14-17, 1991, pp. 641-644.

Mi, Suk L. et al., "On the Use of LSF Intermodal Interlacing Property for Spectral Quantization", Speech Coding Proceedings, 1999 IEEE Workshop on Porvoo, Finland, Jun. 20, 1999, pp. 43-45.

So et al., "Efficient Product Code Vector Quantisation Using the Switched Split Vector Quantiser", Digital Signal Processing, Academic Press, Orlando, FL, vol. 17, No. 1, Dec. 2, 2006, pp. 138-171.

Asakawa, et al., "Technical Papers of Annual Conference of Acoustical Society of Japan", Autumn I, Oct. 5, 1993, pp. 305-306.

Omuro, et al., "Vector and Matrix Quantization of LSP Parameter", Technical Report from the Institute of Electronics, Information and Communication Engineers, SP 91 to 70, Oct. 25, 1991, pp. 29-36.

* cited by examiner $$\underbrace{\begin{bmatrix} LSF_1 \\ LSF_2 \\ \vdots \\ LSF_{16} \end{bmatrix}}_{\substack{\underline{LSF} \\ \text{converted prediction coefficients}}} \longmapsto \underbrace{\begin{bmatrix} IHM_1 \\ IHM_2 \\ \vdots \\ IHM_{16} \end{bmatrix}}_{\substack{\underline{IHM} \\ \text{weighting factors}}} ; \underbrace{\underbrace{\begin{bmatrix} a_1 \\ a_2 \\ \vdots \\ a_{16} \end{bmatrix}}_{\underline{a}} \underbrace{\begin{bmatrix} b_1 \\ b_2 \\ \vdots \\ b_{16} \end{bmatrix}}_{\underline{b}} \underbrace{\begin{bmatrix} c_1 \\ c_2 \\ \vdots \\ c_{16} \end{bmatrix}}_{\underline{c}}}_{\text{correction values}}$$

FIG 4A $$\underline{y} = \underline{a} + \underline{bx} + \underline{cx}^2$$

FIG 4B $$\underbrace{\begin{bmatrix} w_1 \\ w_2 \\ \vdots \\ w_{16} \end{bmatrix}}_{\substack{\underline{w} \\ \text{corrected weighting factors}}} = \begin{bmatrix} a_1 + b_1 IHM_1 + c_1 IHM_1^2 \\ a_2 + b_2 IHM_2 + c_2 IHM_2^2 \\ \\ a_{16} + b_{16} IHM_{16} + c_{16} IHM_{16}^2 \end{bmatrix}$$

FIG 4C $$w_1(LSF'_1 - LSF_1)^2 + w_2(LSF'_2 - LSF_2)^2 + \cdots + w_{16}(LSF'_{16} - LSF_{16})^2$$
$$\triangleq \sum_{i=1}^{16} w_i(LSF'_i - LSF_i)^2$$

FIG 5A $$\begin{matrix} LSF'_1, & LSF'_2 & \cdots & LSF'_{16} = Qu' \\ LSF''_1, & LSF''_2 & \cdots & LSF''_{16} = Qu'' \end{matrix} \quad ; \quad Qu = \begin{bmatrix} Qu' \\ Qu'' \\ Qu''' \\ \vdots \\ Qu^n \end{bmatrix}$$

FIG 5B

ENCODER FOR ENCODING AN AUDIO SIGNAL, AUDIO TRANSMISSION SYSTEM AND METHOD FOR DETERMINING CORRECTION VALUES

CROSS-REFERENCE TO RELATED APPLICATIONS

This application is a division of copending U.S. patent application Ser. No. 15/147,844, filed May 5, 2016, which is a continuation of International Application No. PCT/EP2014/073960, filed Nov. 6, 2014, which claims priority from European Application No. EP 13192735.2, filed Nov. 13, 2013, and from European Application No. EP 14178815.8, filed Jul. 28, 2014, wherein each are incorporated herein in its entirety by this reference thereto.

BACKGROUND OF THE INVENTION

The present invention relates to an encoder for encoding an audio signal, an audio transmission system, a method for determining correction values and a computer program. The invention further relates to immittance spectral frequency/line spectral frequency weighting.

In today's speech and audio codecs it is state of the art to extract the spectral envelope of the speech or audio signal by Linear Prediction and further quantize and code a transformation of the Linear Prediction coefficients (LPC). Such transformations are e.g. the Line Spectral Frequencies (LSF) or Immittance Spectral Frequencies (ISF).

Vector Quantization (VQ) is usually advantageous over scalar quantization for LPC quantization due to the increase of performance. However it was observed that an optimal LPC coding shows different scalar sensitivity for each frequency of the vector of LSFs or ISFs. As a direct consequence, using a classical Euclidean distance as metric in the quantization step will lead to a suboptimal system. It can be explained by the fact that the performance of a LPC quantization is usually measured by distance like Logarithmic Spectral Distance (LSD) or Weighted Logarithmic Spectral Distance (WLSD) which don't have a direct proportional relation with the Euclidean distance.

LSD is defined as the logarithm of the Euclidean distance of the spectral envelopes of original LPC coefficients and the quantized version of them. WLSD is a weighted version which takes into account that the low frequencies are perceptually more relevant than the high frequencies.

Both LSD and WLSD are too complex to be computed within a LPC quantization scheme. Therefore most LPC coding schemes are using either the simple Euclidean distance or a weighted version of it (WED) defined as:

$$WED = \sum_i w_i * (lsf_i - qlsf_i)^2,$$

where $lsf_i$ is the parameter to be quantized and $qlsf_i$ is the quantized parameter. w are weights giving more distortion to certain coefficients and less to other.

Laroia et al. [1] presented a heuristic approach known as inverse harmonic mean to compute weights that give more importance to LSFs closed to formant regions. If two LSF parameters are close together the signal spectrum is expected to comprise a peak near that frequency. Hence an LSF that is close to one of its neighbors has a high scalar sensitivity and should be given a higher weight:

$$w_i = \frac{1}{(lsf_i - lsf_{i-1})} + \frac{1}{(lsf_{i+1} - lsf_i)}$$

The first and the last weighting coefficients are calculated with this pseudo LSFs:

$lsf_0=0$ and $lsf_{p+1}=\pi$, where p is the order of the LP model. The order is usually 10 for speech signal sampled at 8 kHz and 16 for speech signal sampled at 16 kHz.

Gardner and Rao [2] derived the individual scalar sensitivity for LSFs from a high-rate approximation (e.g. when using a VQ with 30 or more bits). In such a case the derived weights are optimal and minimize the LSD. The scalar weights form the diagonal of a so-called sensitivity matrix given by:

$$D_\omega(\omega)=4\beta J_\omega^T(\omega)R_A J_\omega(\omega)$$

Where $R_A$ is the autocorrelation matrix of the impulse response of the synthesis filter 1/A(z) derived from the original predictive coefficients of the LPC analysis. $J_\omega(\omega)$ is a Jacobian matrix transforming LSFs to LPC coefficients.

The main drawback of this solution is the computational complexity for computing the sensitivity matrix.

The ITU recommendation G.718 [3] expands Gardner's approach by adding some psychoacoustic considerations. Instead of considering the matrix $R_A$, it considers the impulse response of a perceptual weighted synthesis filter W(z):

$$W(z)=W_B(z)/(A(z)$$

Where $W_B(z)$ is an IIR filter approximating the Bark weighting filter given more importance to the low frequencies. The sensitivity matrix is then computed by replacing 1/A(z) with W(z).

Although the weighting used in G.718 is theoretically a near-optimal approach, it inherits from Gardner's approach a very high complexity. Today's audio codecs are standardized with a limitation in complexity and therefore the tradeoff of complexity and gain in perceptual quality is not satisfying with this approach.

The approach presented by Laroia et al. may yield suboptimal weights but it is of low complexity. The weights generated with this approach treat the whole frequency range equally although the human's ear sensitivity is highly nonlinear. Distortion in lower frequencies is much more audible than distortion in higher frequencies.

Thus, there is a need for improving encoding schemes.

SUMMARY

According to an embodiment, an encoder for encoding an audio signal may have: an analyzer configured for analyzing the audio signal and for determining analysis prediction coefficients from the audio signal; a converter configured for deriving converted prediction coefficients from the analysis prediction coefficients; a memory configured for storing a multitude of correction values; a calculator including: a processor configured for processing the converted prediction coefficients to obtain spectral weighting factors; a combiner configured for combining the spectral weighting factors and the multitude of correction values to obtain corrected weighting factors; and a quantizer configured for quantizing the converted prediction coefficients using the corrected weighting factors to obtain a quantized representation of the converted prediction coefficients; and a bitstream former configured for forming an output signal based on the quantized representation of the converted prediction coefficients and based on the audio signal; wherein the combiner is configured for applying a polynomial based on a form $w=a+bx+cx^2$ wherein w denotes an obtained corrected weighting factor, x denotes the spectral weighting factor and wherein a, b and c denote correction values.

According to another embodiment, an audio transmissions system may have: an inventive encoder; and a decoder configured for receiving the output signal of the encoder or a signal derived thereof and for decoding the received signal to provide a synthesized audio signal; wherein the encoder is configured to access a transmission media and to transmit the output signal via the transmission media.

According to another embodiment, a method for determining correction values for a first multitude of first weighting factors each weighting factor adapted for weighting a portion of an audio signal may have the steps of: calculating the first multitude of first weighting factors for each audio signal of a set of audio signals and based on a first determination rule; calculating a second multitude of second weighting factors for each audio signal of the set of audio signals based on a second determination rule, each of the second multitude of weighting factors being related to a first weighting factor; calculating a third multitude of distance values each distance value having a value related to a distance between a first weighting factor and a second weighting factor related to a portion of the audio signal; and calculating a fourth multitude of correction values adapted to reduce the distance values when combined with the first weighting factors; wherein the fourth multitude of correction values is determined based on a polynomial fitting including multiplying the values of the first weighting factors with a polynomial ($y=a+bx+cx^2$) including at least one variable for adapting a term of the polynomial.

According to another embodiment, a method for encoding an audio signal may have the steps of: analyzing the audio signal and for determining analysis prediction coefficients from the audio signal; deriving converted prediction coefficients from the analysis prediction coefficients; storing a multitude of correction values; combining the converted prediction coefficients and the multitude of correction values to obtain corrected weighting factors including applying a polynomial based on a form $w=a+bx+cx^2$ wherein w denotes an obtained corrected weighting factor, x denotes the spectral weighting factor and wherein a, b and c denote correction values; quantizing the converted prediction coefficients using the corrected weighting factors to obtain a quantized representation of the converted prediction coefficients; and forming an output signal based on representation of the converted prediction coefficients and based on the audio signal.

Another embodiment may have a non-transitory digital storage medium having a computer program stored thereon to perform the inventive methods when said computer program is run by a computer.

The inventors have found out that by determining spectral weighting factors using a method comprising a low computational complexity and by at least partially correcting the obtained spectral weighting factors using precalculated correction information, the obtained corrected spectral weighting factors may allow for an encoding and decoding of the audio signal with a low computational effort while maintaining encoding precision and/or reduce reduced Line Spectral Distances (LSD).

According to an embodiment of the present invention, an encoder for encoding an audio signal comprises an analyzer for analyzing the audio signal and for determining analysis prediction coefficients from the audio signal. The encoder further comprises a converter configured for deriving converted prediction coefficients from the analysis prediction coefficients and a memory configured for storing a multitude of correction values. The encoder further comprises a calculator and a bitstream former. The calculator comprises a processor, a combiner and a quantizer, wherein the processor is configured for processing the converted predicted to obtain spectral weighting factors. The combiner is configured for combining the spectral weighting factors and the multitude of correction values to obtain corrected weighting factors. The quantizer is configured for quantizing the converted prediction coefficients using the corrected weighting factors to obtain a quantized representation of the converted prediction coefficients, for example, a value related to an entry of prediction coefficients in a database. The bitstream former is configured for forming an output signal based on an information related to the quantized representation of the converted prediction coefficients and based on the audio signal. An advantage of this embodiment is that the processor may obtain the spectral weighting factors by using methods and/or concepts comprising a low computational complexity. A possibly obtained error with respect to other concepts or methods may be corrected at least partially by applying the multitude of correction values. This allows for a reduced computational complexity of weight derivation when compared to a determination rule based on [3] and reduced LSDs when compared to a determination rule according to [1].

Further embodiments provide an encoder, wherein the combiner is configured for combining the spectral weighting factors, the multitude of correction values and a further information related to the input signal to obtain the corrected weighting factors. By using the further information related to the input signal a further enhancement of the obtained corrected weighting factors may be achieved while maintaining a low computational complexity, in particular when the further information related to the input signal is at least partially obtained during other encoding steps, such that the further information may be recycled.

Further embodiments provide an encoder, wherein the combiner is configured for cyclically, in every cycle, obtaining the corrected weighted factors. The calculator comprises a smoother configured for weightedly combining first quantized weighting factors obtained for a previous cycle and second quantized weighting factors obtained for a cycle following the previous cycle to obtain smoothed corrected weighting factors comprising a value between values of the first and the second quantized weighting factors. This allows for a reduction or a prevention of transition distortions, especially in a case when corrected weighting factors of two consecutive cycles are determined such that they comprise a large difference when compared to each.

Further embodiments provide an audio transmission system comprising an encoder and a decoder configured for receiving the output signal of the encoder or a signal derived thereof and for decoding the received signal to provide a synthesized audio signal, wherein the output signal of the encoder is transmitted via a transmission media, such as a wired media or a wireless media. An advantage of the audio transmission system is that the decoder may decode the output signal, the audio signal respectively, based on unchanged methods.

Further embodiments provide a method for determining the correction values for a first multitude of first weighting factors. Each weighting factor is adapted for weighting a portion of an audio signal, for example represented as a line spectral frequency or an immittance spectral frequency. The first multitude of first weighting factors is determined based on a first determination rule for each audio signal. A second multitude of second weighting factors is calculated for each audio signal of the set of audio signals based on a second determination rule. Each of the second multitude of weighting factors is related to a first weighting factor, i.e.

a weighting factor may be determined for a portion of the audio signal based on the first determination rule and based on the second determination rule to obtain two results that may be different. A third multitude of distance values is calculated, the distance values having a value related to a distance between a first weighting factor and a second weighting factor, both related to the portion of the audio signal. A fourth multitude of correction values is calculated adapted to reduce the distance values when combined with the first weighting factors such that when the first weighting factors are combined with the fourth multitude of correction values a distance between the corrected first weighting factors is reduced when compared to the second weighting factors. This allows for computing the weighting factors based on a training data set one time based on the second determination rule comprising a high computational complexity and/or a high precision and another time based on the first determination rule which may comprise a lower computational complexity and may be a lower precision, wherein the lower precision and/or compensated or reduced at least partially by correction.

Further embodiments provide a method in which the distance is reduced by adapting a polynomial, wherein polynomial coefficients relate to the correction values. Further embodiments provide a computer program.

BRIEF DESCRIPTION OF THE DRAWINGS

Embodiments of the present invention will be detailed subsequently referring to the appended drawings, in which:

FIG. 4*a* illustrates a vector comprising 16 values of line spectral frequencies which are obtained by a converter based on the determined prediction coefficients according to an embodiment;

FIG. 4*b* illustrates a determination rule executed by a combiner according to an embodiment;

FIG. 4*c* shows an exemplary determination rule for illustrating the step of the obtaining corrected weighting factors according to an embodiment;

FIG. 5*a* depicts an exemplary determination scheme which may be implemented by a quantizer to determine a quantized representation of the converted prediction coefficients according to an embodiment;

FIG. 5*b* shows an exemplary vector of quantization values that may be combined to sets thereof according to an embodiment;

DETAILED DESCRIPTION OF THE INVENTION

Figure 1:
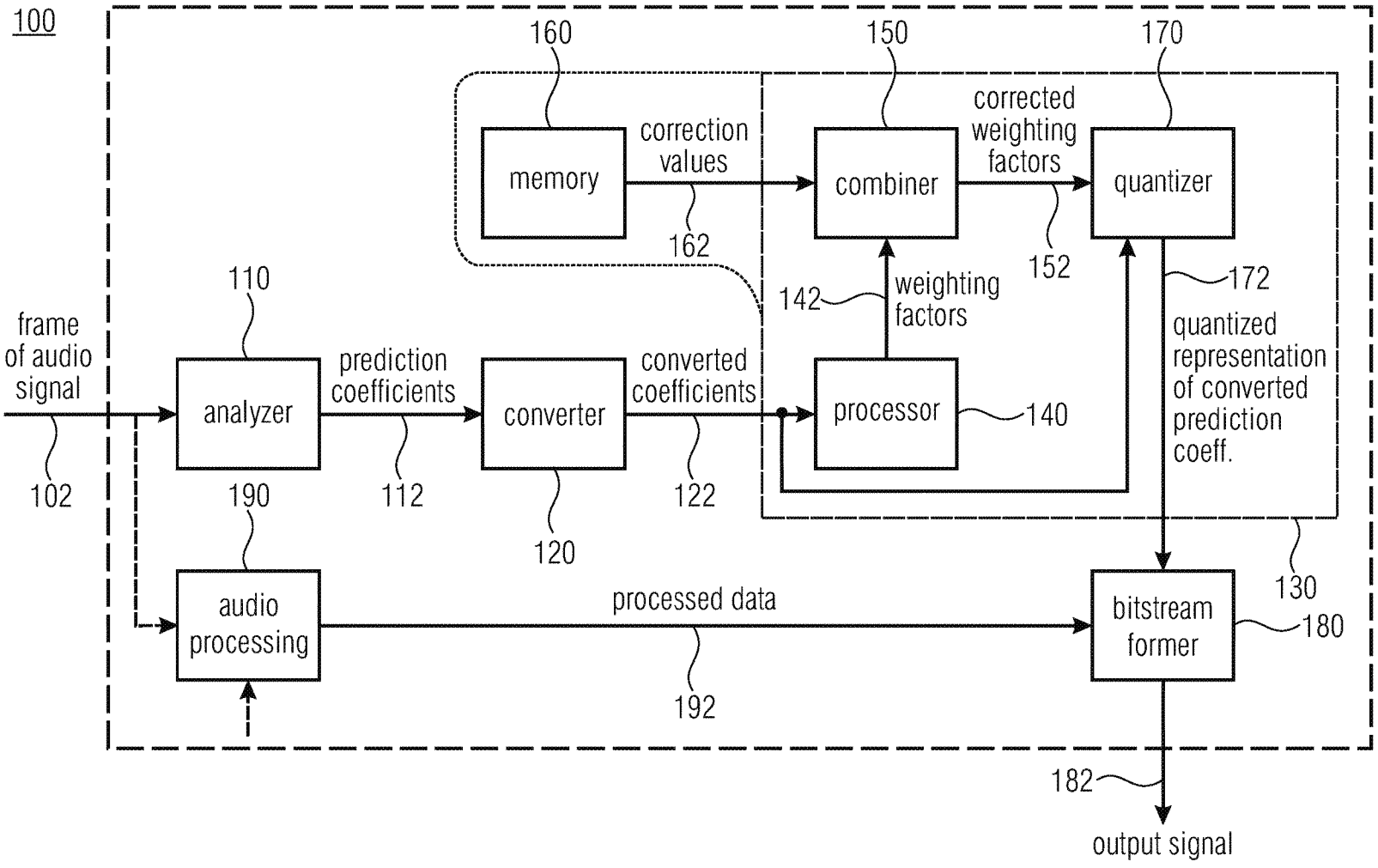
FIG. 1 shows a schematic block diagram of an encoder for encoding an audio signal according to an embodiment.

Equal or equivalent elements or elements with equal or equivalent functionality are denoted in the following description by equal or equivalent reference numerals even if occurring in different figures.

In the following description, a plurality of details is set forth to provide a more thorough explanation of embodiments of the present invention. However, it will be apparent to those skilled in the art that embodiments of the present invention may be practiced without these specific details. In other instances, well known structures and devices are shown in block diagram form rather than in detail in order to avoid obscuring embodiments of the present invention. In addition, features of the different embodiments described hereinafter may be combined with each other, unless specifically noted otherwise.

FIG. 1 shows a schematic block diagram of an encoder 100 for encoding an audio signal. The audio signal may be obtained by the encoder 100 as a sequence of frames 102 of the audio signal. The encoder 100 comprises an analyzer for analyzing the frame 102 and for determining analysis prediction coefficients 112 from the audio signal 102. The analysis prediction coefficients (prediction coefficients) 112 may be obtained, for example, as linear prediction coefficients (LPC). Alternatively, also non-linear prediction coefficients may be obtained, wherein linear prediction coefficients may be obtained by utilizing less computational power and therefore may be obtained faster.

The encoder 100 comprises a converter 120 configured for deriving converted prediction coefficients 122 from the prediction coefficients 112. The converter 120 may be configured for determining the converted prediction coefficients 122 to obtain, for example, Line Spectral Frequencies (LSF) and/or Immittance Spectral Frequencies (ISF). The converted prediction coefficients 122 may comprise a higher robustness with respect to quantization errors in a later quantization when compared to the prediction coefficients 112. As quantization is usually performed non-linearly, quantizing linear prediction coefficients may lead to distortions of a decoded audio signal.

The encoder 100 comprises a calculator 130. The calculator 130 comprises a processor 140 which is configured to process the converted prediction coefficients 122 to obtain spectral weighting factors 142. The processor may be configured to calculate and/or to determine the weighting factors 142 based on one or more of a plurality of known determination rules such as an inverse harmonic mean (IHM) as it is known from [1] or according to a more complex approach as it is described in [2]. The International Telecommunication Union (ITU) Standard G.718 describes a further approach of determining weighting factors by expanding the approach of [2] as it is described in [3]. The processor 140 is configured to determine the weighting factors 142 based on a determination rule comprising a low computational complexity. This may allow for a high throughput of encoded audio signals and/or a simple realization of the encoder 100 due to hardware that may consume less energy based on less computational efforts.

The calculator 130 comprises a combiner 150 configured for combining the spectral weighting factors 142 and a multitude of correction values 162 to obtain corrected weighting factors 152. The multitude of correction values is provided from a memory 160 in which the correction values 162 are stored. The correction values 162 may be static or dynamic, i.e. the correction values 162 may be updated during operation of the encoder 100 or may remain unchanged during operation and/or may be only updated during a calibration procedure for calibrating the encoder 100. The memory 160 comprises static correction values 162. The correction values 162 may be obtained, for example, by a precalculation procedure as it is described later on. Alternatively, the memory 160 may alternatively be comprised by the calculator 130 as it is indicated by the dotted lines.

The calculator 130 comprises a quantizer 170 configured for quantizing the converted prediction coefficients 122 using the corrected weighting factors 152. The quantizer 170 is configured to output a quantized representation 172 of the converted prediction coefficients 122. The quantizer 170 may be a linear quantizer, a non-linear quantizer such as a logarithmic quantizer or a vector-like quantizer, a vector quantizer respectively. A vector-like quantizer may be configured to quantize a plurality pf portions of the corrected weighting factors 152 to a plurality of quantized values (portions). The quantizer 170 may be configured for weighting the converted prediction coefficients 122 with the corrected weighting factors 152. The quantizer may further be configured for determining a distance of the weighted converted prediction coefficients 122 to entries of a database of the quantizer 170 and to select a code word (representation) that is related to an entry in the database wherein the entry may comprise a lowest distance to the weighted converted prediction coefficients 122. Such a procedure is exemplarily described later on. The quantizer 170 may be a stochastic Vector Quantizer (VQ). Alternatively, the quantizer 170 may also be configured for applying other Vector Quantizers like Lattice VQ or any scaler quantizer. Alternatively, the quantizer 170 may also be configured to apply a linear or logarithmic quantization.

The quantized representation 172 of the converted prediction coefficients 122, i.e. the code word, is provided to a bitstream former 180 of the encoder 100. The encoder 100 may comprise an audio processing unit 190 configured for processing some or all of the audio information of the audio signal 102 and/or further information. Audio processing unit 190 is configured for providing audio data 192 such as a voiced signal information or an unvoiced signal information to the bitstream former 180. The bitstream former 180 is configured for forming an output signal (bitstream) 182 based on the quantized representation 172 of the converted prediction coefficients 122 and based on the audio information 192, which is based on the audio signal 102.

An advantage of the encoder 100 is that the processor 140 may be configured to obtain, i.e. to calculate, the weighting factors 142 by using a determination rule that comprises a low computational complexity. The correction values 162 may be obtained by, when expressed in a simplified manner, comparing a set of weighting factors obtained by a (reference) determination rule with a high computational complexity but therefore comprising a high precision and/or a good audio quality and/or a low LSD with weighting factors obtained by the determination rule executed by the processor 140. This may be done for a multitude of audio signals, wherein for each of the audio signals a number of weighting factors is obtained based on both determination rules. For each audio signal, the obtained results may be compared to obtain an information related to a mismatch or an error. The information related to the mismatch or the error may be summed up and/or averaged with respect to the multitude of audio signals to obtain an information related to an average error that is made by the processor 140 with respect to the reference determination rule when executing the determination rule with the lower computational complexity. The obtained information related to the average error and/or mismatch may be represented in the correction values 162 such that the weighting factors 142 may be combined with the correction values 162 by the combiner to reduce or compensate the average error. This allows for reducing or almost compensating the error of the weighting factors 142 when compared to the reference determination rule used offline while still allowing for a less complex determination of the weighting factors 142.

Figure 2:
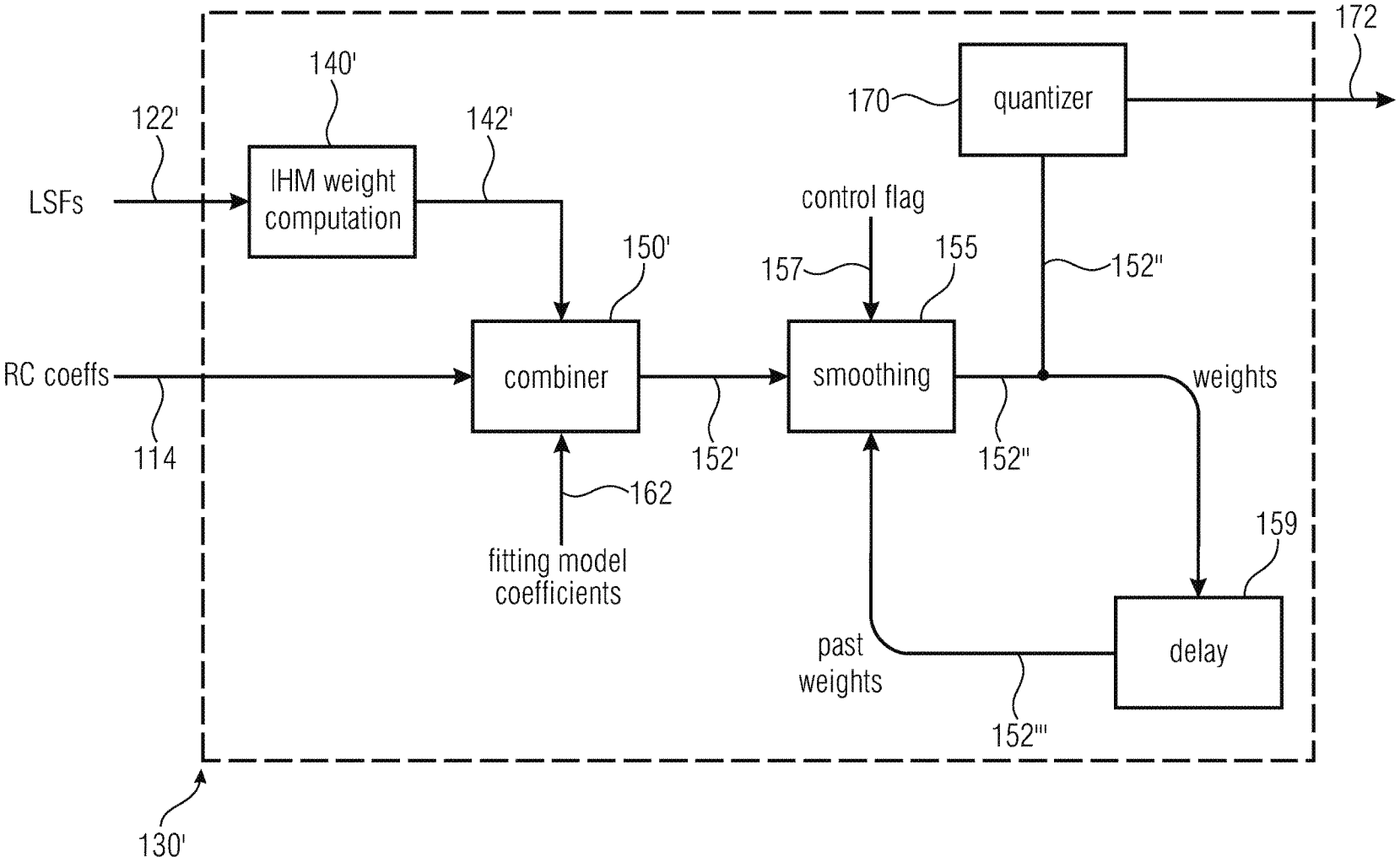
FIG. 2 shows a schematic block diagram of a calculator according to an embodiment wherein the calculator is modified when compared to a calculator shown in FIG. 1.

FIG. 2 shows a schematic block diagram of a modified calculator 130'. The calculator 130' comprises a processor 140' configured for calculating inverse harmonic mean (IHM) weights from the LSF 122', which represent the converted prediction coefficients. The calculator 130' comprises a combiner 150' which, when compared to the combiner 150, is configured for combining the IHM weights 142' of the processor 140', the correction values 162 and a further information 114 of the audio signal 102 indicated as "reflection coefficients", wherein the further information 114 is not limited thereto. The further information may be an interim result of other encoding steps, for example, the reflection coefficients 114 may be obtained by the analyzer 110 during determining the prediction coefficients 112 as it is described in FIG. 1. Linear prediction coefficients may be determined by the analyzer 110 when executing a determination rule according to the Levinson-Durbin algorithm in which reflection algorithms are determined. An information related to the power spectrum may also be obtained during calculating the prediction coefficients 112. A possible implementation of the combiner 150' is described later on. Alternatively, or in addition, the further information 114 may be combined with the weights 142 or 142' and the correction parameters 162, for example, information related to a power spectrum of the audio signal 102. The further information 114 allows for further reducing a difference between weights 142 or 142' determined by the calculator 130 or 130' and the reference weights. An increase of computational complexity may only have minor effects as the further information 114 may already be determined by other components such as the analyzer 110 during other steps of the audio encoding.

The calculator 130' further comprises a smoother 155 configured for receiving corrected weighting factors 152' from the combiner 150' and an optional information 157 (control flag) allowing for controlling operation (ON-/OFF-state) of the smoother 155. The control flag 157 may be obtained, for example, from the analyzer indicating that smoothing is to be performed in order to reduce harsh transitions. The smoother 155 is configured for combining corrected weighting factors 152' and corrected weighting factors 152''' which are a delayed representation of corrected weighting factors determined for a previous frame or subframe of the audio signal, i.e. corrected weighting factors determined in a previous cycle in the ON-state. The smoother 155 may be implemented as an infinite impulse response (IIR) filter. Therefore, the calculator 130' comprises a delay block 159 configured for receiving and delaying corrected weighting factors 152'' provided by the smoother 155 in a first cycle and to provide those weights as the corrected weighting factors 152''' in a following cycle.

The delay block 159 may be implemented, for example, as a delay filter or as a memory configured for storing the received corrected weighting factors 152''. The smoother 155 is configured for weightedly combining the received corrected weighting factors 152' and the received corrected weighting factors 152''' from the past. For example, the (present) corrected weighting factors 152' may comprise a share of 25%, 50%, 75% or any other value in the smoothed corrected weighting factors 152'', wherein the (past) weighting factors 152''' may comprise a share of (1-share of corrected weighting factors 152'). This allows for avoiding harsh transitions between subsequent audio frames when the audio signal, i.e. two subsequent frames thereof, result in different corrected weighting factors which would lead to distortions in a decoded audio signal. In the OFF-state, the smoother 155 is configured for forwarding the corrected weighting factors 152'. Alternatively or in addition, smoothing may allow for an increased audio quality for audio signals comprising a high level of periodicity.

Alternatively, the smoother 155 may be configured to additionally combine corrected weighted factors of more previous cycles. Alternatively or in addition, the converted prediction coefficients 122' may also be the Immittance Spectral Frequencies.

A weighting factor $w_i$ may be obtained, for example, based on the inverse harmonic mean (IHM). A determination rule may be based on a form:

$$w_i = \frac{1}{(lsf_i - lsf_{i-1})} + \frac{1}{(lsf_{i+1} - lsf_i)},$$

wherein $w_i$ denotes a determined weight 142' with index i, $LSF_i$ denotes a line spectral frequency with index i. The index i corresponds to a number of spectral weighting factors obtained and may be equal to a number of prediction coefficients determined by the analyzer.

The number of prediction coefficients and therefore the number of converted coefficients may be, for example, 16. Alternatively, the number may also be 8 or 32. Alternatively, the number of converted coefficients may also be lower than the number of prediction coefficients, for example, if the converted coefficients 122 are determined as Immittance Spectral Frequencies which may comprise a lower number when compared to the number of prediction coefficients.

In other words, FIG. 2 details the processing done in the weight's derivation step executed by the converter 120. First the IHM weights are computed from the LSFs. According to one embodiment, an LPC order of 16 is used for a signal sampled at 16 kHz. That means that the LSFs are bounded between 0 and 8 kHz. According to a further embodiment, the LPC is of order 16 and the signal is sampled at 12.8 kHz. In that case, the LSFs are bounded between 0 and 6.4 kHz. According to a further embodiment, the signal is sampled at 8 kHz, which may be called a narrow band sampling. The IHM weights may then be combined with further information, e.g. related to some of the reflection coefficients, within a polynomial for which the coefficients are optimized offline during a training phase. Finally, the obtained weights can be smoothed by the previous set of weights in certain cases, for example for stationary signals. According to an embodiment, the smoothing is never performed. According to other embodiments, it is performed only when the input frame is classified as being voiced, i.e. signal detected as being highly periodic.

In the following, reference will be made to details of correcting the derived weighting factors. For example, the analyzer is configured to determine linear prediction coefficients (LPC) of order 10 or 16, i.e. a number of 10 or 16 LPC. Although the analyzer may also be configured to determine any other number of linear prediction coefficients or a different type of coefficient, the following description is made with reference to 16 coefficients, as this number of coefficients is used in mobile communication.

Figure 3:
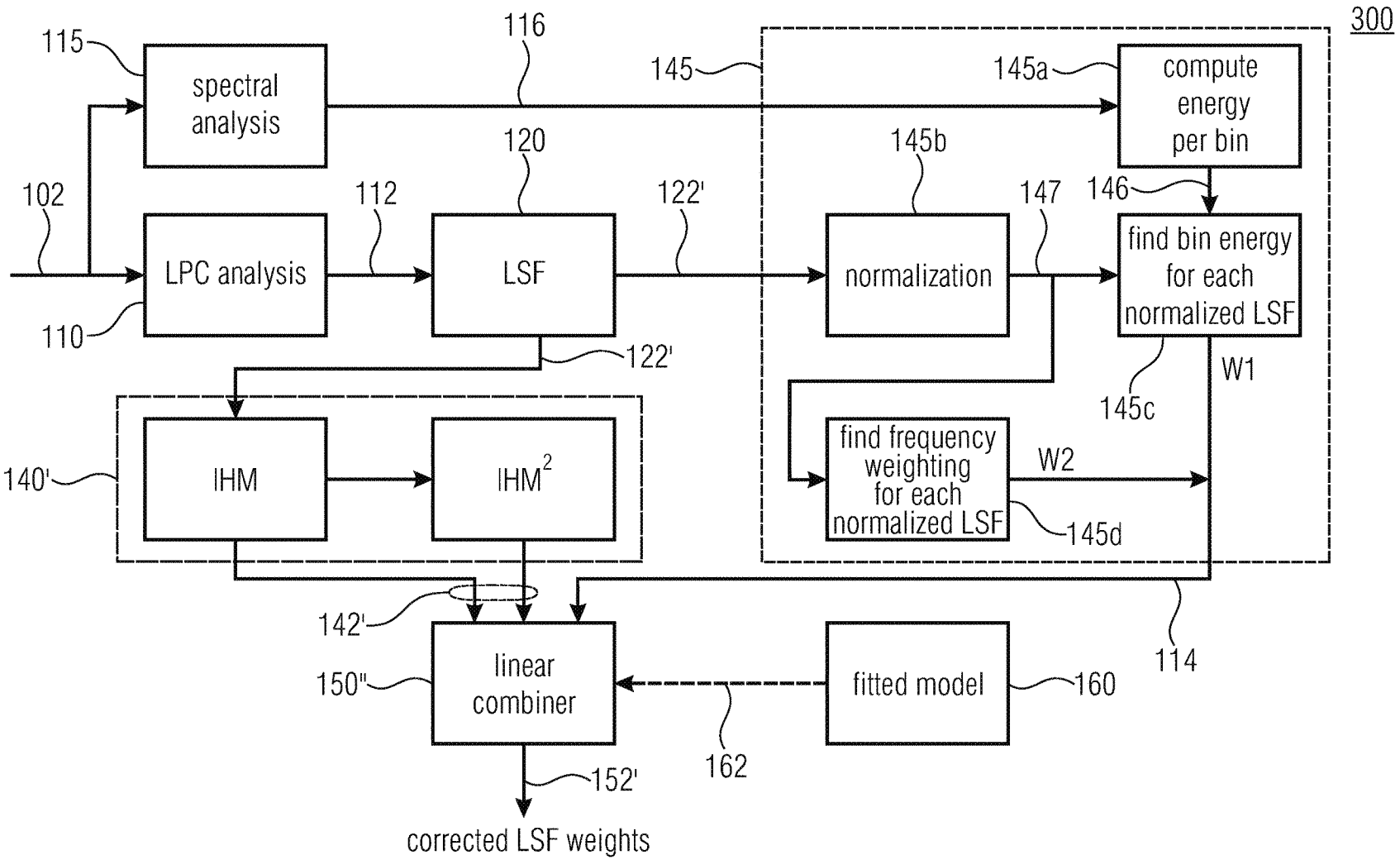
FIG. 3 shows a schematic block diagram of an encoder additionally comprising a spectral analyzer and a spectral processor according to an embodiment.

FIG. 3 shows a schematic block diagram of an encoder 300 additionally comprising a spectral analyzer 115 and a spectral processor 145 comprising when compared to the encoder 100. The spectral analyzer 115 is configured for deriving spectral parameters 116 from the audio signal 102. The spectral parameters may be, for example, an envelope curve of a spectrum of the audio signal or of a frame thereof and/or parameters characterizing the envelope curve. Alternatively coefficients related to the power spectrum may be obtained.

The spectral processor 145 comprises an energy calculator **145*a* which is configured to compute an amount or a measure 146 for an energy of frequency bins of the spectrum of the audio signal 102 based on the spectral parameters 116. The spectral processor further comprises a normalizer 145*b* for normalizing the converted prediction coefficients 122' (LSF) to obtain normalized prediction coefficients 147**. The converted prediction coefficients may be normalized, for example, relatively, with respect to a maximum value of a plurality of the LSF and/or absolutely, i.e. with respect to a predetermined value such as a maximum value being expected or being representable by used computation variables.

The spectral processor 145 further comprises a first determiner **145*c* configured for determining a bin energy for each normalized prediction parameter, i.e., to relate each normalized prediction parameter 147 obtained from the normalizer 145*b* to a computed to a measure 146 to obtain a vector W1 containing the bin energy for each LSF. The spectral processor 145 further comprises a second determiner 145*d* configured for finding (determining) a frequency weighting for each normalized LSF to obtain a vector W2 comprising the frequency weightings. The further information 114 comprises the vectors W1 and W2, i.e., the vectors W1 and W2 are the feature representing the further information 114**.

The processor 142' is configured for determining the IHM based on the converted prediction parameters 122' and a power of the IHM, for example the second power, wherein alternatively or in addition also a higher power may be computed, wherein the IHM and the power(s) thereof form the weighting factors 142'.

A combiner 150'' is configured for determining the corrected weighting factors (corrected LSF weights) 152' based on the further information 114 and the weighting factors 142'.

Alternatively, the processor 140', the spectral processor 145 and/or the combiner may be implemented as a single processing unit such as a Central processing unit, a (micro-) controller, a programmable gate array or the like.

In other words, a first and a second entry to the combiner are IHM and $IHM^2$, i.e. the weighting factors 142'. A third entry is for each LSF-vector element i:

$$\widehat{wfft}_i = (\sqrt{wfft_i - min} + 2) * FreqWTable[normLsf_i]$$

wherein wfft is the combination of W1 and W2 and wherein min is the minimum of wfft.

i=0 . . . M where M may be 16 when 16 prediction coefficients are derived from the audio signal and $$wfft_i = 10 * \log_{10}(\max(binEner[\lfloor lsf_i/50+0.5 \rfloor - 1], binEner[[lsf_i/50+0.5]], binEner[\lfloor lsf_i/50+0.5 \rfloor + 1]))$$

wherein binEner contains the energy of each bin of the spectrum, i.e., binEner corresponds to the measure 146.

The mapping binEner [[$lsf_i$/50+0.5]] is a rough approximation of the energy of a formant in the spectral envelope. FreqWTable is a vector containing additional weights which are selected depending on the input signal being voiced or unvoiced.

Wfft is an approximation of the spectral energy close to a prediction coefficient like a LSF coefficient. In simple terms, if a prediction (LSF) coefficient comprises a value X, this means that the spectrum of the audio signal (frame) comprises an energy maximum (formant) at the Frequency X or beneath thereto. The wfft is a logarithmic expression of the energy at frequency X, i.e., it corresponds to the logarithmic energy at this location. When compared to embodiments described before as utilizing reflection coefficients as further information, alternatively or in addition a combination of wfft (W1) and FrequWTable (W2) may be used to obtain the further information 114. FreqWTable describes one of a plurality of possible tables to be used. Based on a "coding mode" of the encoder 300, e.g., voiced, fricative or the like, at least one of the plurality of tables may be selected. One or more of the plurality of tables may be trained (programmed and adapted) during operation of the encoder 300.

A finding of using the wfft is to enhance coding of converted prediction coefficients that represent a formant. In contrast to classical noise shaping in which the noise is at frequencies comprising large amounts of (signal) energy the described approach relates to quantize the spectral envelope curve. When the power spectrum comprises a large amount of energy (a large measure) at frequencies comprising or arranged adjacent to a frequency of a converted prediction coefficient, this converted prediction coefficient (LSF) may be quantized better, i.e., with lower errors achieved by higher weightings, than other coefficients comprising a lower measure of energy.

FIG. 4*a* illustrates a vector LSF comprising 16 values of entries of the determined line spectral frequencies which are obtained by the converter based on the determined prediction coefficients. The processor is configured to also obtain 16 weights, exemplarily inverse harmonic means IHM represented in a vector IHM. The correction values 162 are grouped, for example, to a vector a, a vector b, and a vector c. Each of the vectors a, b and c comprises 16 values $a_{1-16}$, $b_{1-16}$ and $c_{1-16}$, wherein equal indices indicate that the respective correction value is related to a prediction coefficient, a converted representation thereof and a weighting factor comprising the same index. FIG. 4*b* illustrates a determination rule executed by the combiner 150 or 150' according to an embodiment. The combiner is configured for computing or determining a result for a polynomial function based on a form $\underline{y}=\underline{a}+\underline{bx}+\underline{cx}^2$ i.e. different correction values a, b, c are combined (multiplied) with different powers of the weighting factors (illustrated as x). y denotes a vector of obtained corrected weighting factors.

Alternatively or in addition, the combiner may also be configured to add further correction values (d, e, f, . . . ) and further powers of the weighting factors or of the further information. For example, the polynomial depicted in FIG. 4*b* may be extended by a vector d comprising 16 values being multiplied with a third power of the further information 114, a respective vector also comprising 16 values. This may be, for example a vector based on $IHM^3$ when the processor 140' as described in FIG. 3 is configured to determine further powers of IHM. Alternatively, only at least the vector b and optionally one or more of the higher order vectors c, d, . . . may be computed. Simplified the order of the polynomial increases with each term, wherein each type may be formed based on the weighting factor and/or optionally based on the further information, wherein the polynomial is based on the form $\underline{y}=\underline{a}+\underline{bx}+\underline{cx}^2$ also when comprising a term of higher order. The correction values a, b, c and optionally d, e, . . . may comprise values real and/or imaginary values and may also comprise a value of zero.

FIG. 4*c* depicts an exemplary determination rule for illustrating the step of the obtaining the corrected weighting factors 152 or 152'. The corrected weighting factors are represented in a vector w comprising 16 values, one weighting factor for each of the converted prediction coefficients depicted in FIG. 4*a*. Each of the corrected weighting factors $w_{1-16}$ is computed according to the determination rule shown in FIG. 4*b*. The above descriptions shall only illustrate a principle of determining the corrected weighting factors and shall not be limited to the determination rules described above. The above described determination rules may also be varied, scaled, shifted or the like. In general, the corrected weighting factors are obtained by performing a combination of the correction values with the determined weighting factors.

FIG. 5*a* depicts an exemplary determination scheme which may be implemented by a quantizer such as the quantizer 170 to determine the quantized representation of the converted prediction coefficients. The quantizer may sum up an error, e.g. a difference or a power thereof between a determined converted coefficient shown as $LSF_i$ and a reference coefficient indicated as $LSF'_I$, wherein the reference coefficients may be stored in a database of the quantizer. The determined distance may be squared such that only positive values are obtained. Each of the distances (errors) is weighted by a respective weighting factor $w_i$. This allows for giving frequency ranges or converted prediction coefficients with a higher importance for audio quality a higher weight and frequency ranges with a lower importance for audio quality a lower weight. The errors are summed up over some or all of the indices 1-16 to obtain a total error value. This may be done for a plurality of predefined combinations (database entries) of coefficients that may be combined to sets Qu', Qu", . . . $Qu^n$ as indicated in FIG. 5*b*. The quantizer may be configured for selecting a code word related to a set of the predefined coefficients comprising a minimum error with respect to the determined corrected weighted factors and the converted prediction coefficients. The code word may be, for example, an index of a table such that a decoder may restore the predefined set Qu', Qu", . . . based on the received index, the received code word, respectively.

To obtain the correction values during a training phase, a reference determination rule according to which reference weights are determined is selected. As the encoder is configured to correct determined weighting factors with respect to the reference weights and determination of the reference weights may be done offline, i.e. during a calibration step or the like, a determination rule comprising a high precision (e.g., low LSD) may be selected while neglecting resulting computational effort. A method comprising a high precision and maybe a high computation complexity may be selected to obtain pre-sized reference weighting factors. For example, a method to determine weighting factors according to the G.718 Standard [3] may be used.

A determination rule according to which the encoder will determine the weighting factors is also executed. This may be a method comprising a low computational complexity while accepting a lower precision of the determined results. Weights are computed according to both determination rules while using a set of audio material comprising, for example, speech and/or music. The audio material may be represented in a number of M training vectors, wherein M may comprise a value of more than 100, more than 1000 or more than 5000. Both sets of obtained weighting factors are stored in a matrix, each matrix comprising vectors that are each related to one of the M training vectors.

For each of the M training vectors, a distance is determined between a vector comprising the weighting factors determined based on the first (reference) determination rule and a vector comprising the weighting vectors determined based on the encoder determination rule. The distances are summed up to obtain a total distance (error), wherein the total error may be averaged to obtain an average error value.

During determination of the correction values, an objective may be to reduce the total error and/or the average error. Therefore, a polynomial fitting may be executed based on the determination rule shown in FIG. 4*b*, wherein the vectors a, b, c and/or further vectors are adapted to the polynomial such that the total and/or average error is reduced or minimized. The polynomial is fit to the weighting factors determined based on the determination rule, which will be executed at the decoder. The polynomial may be fit such that the total error or the average error is below a threshold value, for example, 0.01, 0.1 or 0.2, wherein 1 indicates a total mismatch. Alternatively or in addition, the polynomial may be fit such that the total error is minimized by utilizing based on an error minimizing algorithm. A value of 0.01 may indicate a relative error that may be expressed as a difference (distance) and/or as a quotient of distances. Alternatively, the polynomial fitting may be done by determining the correction values such that the resulting total error or average error comprises a value that is close to a mathematical minimum. This may be done, for example, by derivation of the used functions and an optimization based on setting the obtained derivation to zero.

A further reduction of the distance (error), for example the Euclidian distance, may be achieved when adding the additional information, as it is shown for 114 at encoder side. This additional information may also be used during calculating the correction parameters. The information may be used by combining the same with the polynomial for determining the correction value.

In other words first the IHM weights and the G.718 weights may be extracted from a database containing more than 5000 seconds (or M training vectors) of speech and music material. The IHM weights may be stored in the matrix I and the G.718 weights may be stored in the matrix G. Let $I_i$ and $G_i$ be vectors containing all IHM and G.718 weights $w_i$ of the i-th ISF or LSF coefficient of the whole training database. The average Euclidean distance between these two vectors may be determined based on:

$$d_i = \frac{1}{M}\sum^{M}(I_i - G_i)^2$$

In order to minimize the distance between these two vectors a second order polynomial may be fit:

$$d_i = \frac{1}{M}\sum^{M}(p_{0,i} + p_{1,i}\, I_i + p_{2,i} I_i^2 - G_i)^2$$

A matrix $$EI_i = \begin{bmatrix} 1 & I_{1,i} & I_{1,i}^2 \\ 1 & I_{2,i} & I_{2,i}^2 \\ \vdots & \vdots & \vdots \end{bmatrix}$$

may be introduced and a vector $P_i=[p_{0,i}\ p_{1,i}\ p_{2,i}]^T$ in order to rewrite:

$$p_{0,i} + p_{1,i}\, I_i + p_{2,i} I_i^2 = EI_i P_i$$

and:

$$d_i = \frac{1}{M}\sum^{M}(EI_i P_i - G_i)^2$$

In order to get the vector $P_i$ having the lowest average Euclidean distance the derivation $$\frac{\partial d_i}{\partial P_i}$$

may be set to zero:

$$\frac{\partial d_i}{\partial P_i} = 2\, EI_i^T (G - EI_i P_i) = 0$$

to obtain:

$$P_i = (EI_i^H EI_i)^{-1} EI_i^H G_i$$

To further reduce the difference (Euclidean distance) between the proposed weights and the G.718 weights reflection coefficients of other information may be added to the matrix $EI_i$. Because, for example, the reflection coefficients carry some information about the LPC model which is not directly observable in the LSF or ISF domain, they help to reduce the Euclidean distance $d_i$. In practice probably not all reflection coefficients will lead to a significant reduction in Euclidean distance. The inventors found that it may be sufficient to use the first and the 14th reflection coefficient. Adding the reflection coefficients the matrix $EI_i$ will look like:

$$EI_i = \begin{bmatrix} 1 & I_{1,i} & I_{1,i}^2 & r_{1,1} & r_{1,2} & \cdots \\ 1 & I_{2,i} & I_{2,i}^2 & r_{2,1} & r_{2,2} & \cdots \\ \vdots & \vdots & \vdots & \vdots & \vdots & \ddots \end{bmatrix},$$

where $r_{x,y}$ is the y-th reflection coefficient (or the other information) of the x-th instance in the training dataset. Accordingly the dimension of vector $P_i$ will comprise changed dimensions according to the number of columns in matrix $EI_i$. The calculation of the optimal vector $P_i$ stays the same as above.

By adding further information, the determination rule depicted in FIG. 4*b* may be changed (extended) according to $\underline{y}=\underline{a}+\underline{b}\ \underline{x}+\underline{c}\ \underline{x}^2+\underline{d}\ \underline{r}_1^3+\ldots$.

Figure 6:
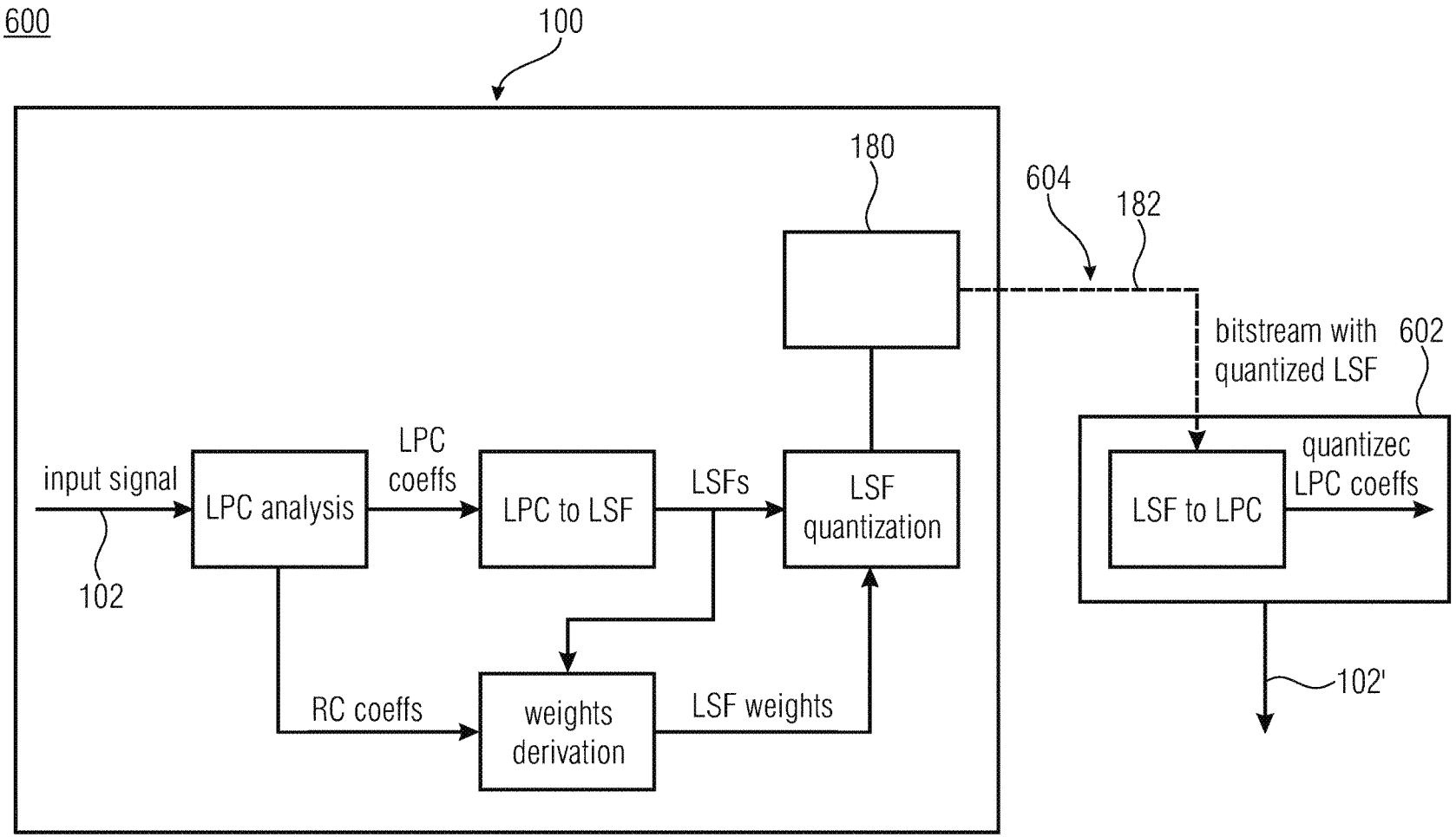
FIG. 6 shows a schematic block diagram of an audio transmission system according to an embodiment.

FIG. 6 shows a schematic block diagram of an audio transmission system 600 according to an embodiment. The audio transmission system 600 comprises the encoder 100 and a decoder 602 configured to receive the output signal 182 as a bitstream comprising the quantized LSF, or an information related thereto, respectively. The bitstream is sent over a transmission media 604, such as a wired connection (cable) or the air.

In other words, FIG. 6 shows an overview of the LPC coding scheme at the encoder side. It is worth mentioning that the weighting is used only by the encoder and is not needed by the decoder. First a LPC analysis is performed on the input signal. It outputs LPC coefficients and reflection coefficients (RC). After the LPC analysis the LPC predictive coefficients are converted to LSFs. These LSFs are vector quantized by using a scheme like a multi-stage vector quantization and then transmitted to the decoder. The code word is selected according to a weighted squared error distance called WED as introduced in the previous section. For this purpose associated weights have to be computed beforehand. The weights derivation is function of the original LSFs and the reflection coefficients. The reflection coefficients are directly available during the LPC analysis as intern variables needed by the Levinson-Durbin algorithm.

Figure 7:
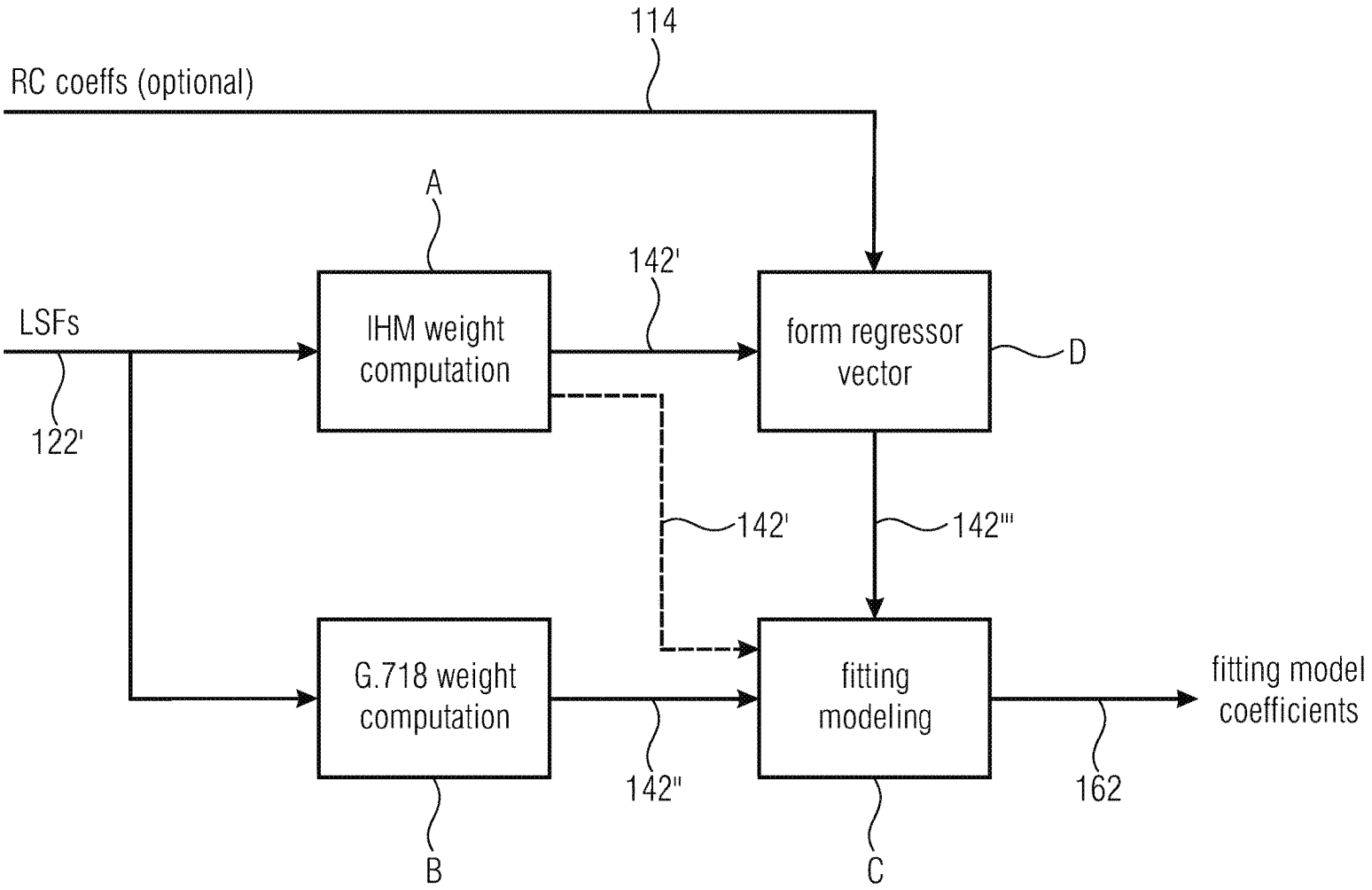
FIG. 7 illustrates an embodiment of deriving the correction values.

FIG. 7 illustrates an embodiment of deriving the correction values as it was described above. The converted prediction coefficients 122' (LSFs) or other coefficients are used for determining weights according to the encoder in a block A and for computing corresponding weights in a block B. The obtained weights 142 are either directly combined with obtained reference weights 142" in a block C for fitting the modeling, i.e. for computing the vector $P_i$ as indicated by the dashed line from block A to block C. Optionally, if the further information 114 is such as the reflection coefficients or the spectral power information is used for determining the correction values 162, the weights 142' are combined with the further information 114 in a regression vector indicated as block D as it was described by extended Eli by the reflection values. Obtained weights 142'" are then combined with the reference weighting factors 142" in the block C.

In other words, the fitting model of block C is the vector P which is described above. In the following, a pseudo-code exemplarily summarizes the weight derivation processing:

```
Input: lsf = original LSF vector
                order = order of LPC, length of lsf
                parcorr[0] = - 1st reflection coefficient
                parcorr[1] = - 14th reflection coefficient
                smooth_flag= flag for smoothing weights
            w_past = past weights
Output
            weights = computed weights
/*Compute IHM weights*/
 weights[0] = 1.f/( lsf[0] - 0 ) + 1.f/( lsf[1] - lsf[0] );
 for(i=1; i<order-1; i++)
        weights[i] = 1.f/( lsf[i] - lsf[i-1] ) + 1.f/( lsf[i+1] - lsf[i] );
  weights[order-1] = 1.f/( lsf[order-1] - lsf[order-2] ) + 1.f/
  ( 8000 - lsf[order-1] );
 /* Fitting model*/
 for(i=0; i<order; i++)
 {
  weights[i] *= (8000/ PI);
        weights[i] = ((float)(lsf_fit_model[0][i])/(1<<12))
              + weights[i]*((float)(lsf_fit_model[1][i])/(1<<14))
              + weights[i]*weights[i]*((float)(lsf_fit_model[2][i])/(1<<19))
              + parcorr[0]* ((float)(lsf_fit_model[3][i])/(1<<13))
              + parcorr[1] * ((float)(lsf_fit_model[4][i])/(1<<10));
   /* avoid too low weights and negative weights*/
   if(weights[i] < 1.f/(i+1))
        weights[i] = 1.f/(i+1);
 }
wherein "parcorr" indicates the extension of the matrix EI
 if(smooth_flag){
  for(i=0; i<order; i++) {
        tmp = 0.75f*weights[i] * 0.25f*w_past[i];
```

-continued

```
        w_past[i]=weights[i];
        weights[i]=tmp;
  }
}
```

which indicates the smoothing described above in which present weights are weighted with a factor of 0.75 and past weights are weighted with a factor of 0.25.

The obtained coefficients for the vector P may comprise scalar values as indicated exemplarily below for a signal sampled at 16 kHz and with a LPC order of 16:

```
lsf_fit_model[5][16] = {
        {679, 10921, 10643, 4998, 11223, 6847, 6637, 5200,
        3347, 3423, 3208, 3329, 2785, 2295, 2287, 1743},
        {23735, 14092, 9659, 7977, 4125, 3600, 3099, 2572,
        2695, 2208, 1759, 1474, 1262, 1219, 931, 1139},
        {-6548, -2496, -2002, -1675, -565, -529, -469,
        -395, -477, -423, -297, -248, -209, -160, -125, -217},
        {-10830, 10563, 17248, 19032, 11645, 9608, 7454, 5045,
        5270, 3712, 3567, 2433, 2380, 1895, 1962, 1801},
        {-17553, 12265, -758, -1524, 3435, -2644, 2013, -616,
        -25, 651, -826, 973, -379, 301, 281, -165}};
```

As stated above, instead of the LSF also the ISF may be provided by the converter as converted coefficients 122. A weight derivation may be very similar as indicated by the following pseudo-code. ISFs of order N are equivalent to LSFs of order N−1 for the N−1 first coefficients to which we append the Nth reflection coefficients. Therefore the weights derivation is very close to the LSF weights derivation. It is given by the following pseudo-code:

```
Input: isf = original ISF vector
                order = order of LPC, length of lsf
                parcorr[0] = - 1st reflection coefficient
                parcorr[1] = - 14th reflection coefficient
                smooth_flag= flag for smoothing weights
                w_past = past weights
Output
            weights = computed weights
/*Compute IHM weights*/
 weights[0] = 1.f/( lsf[0] - 0 ) + 1.f/( lsf[1] - lsf[0] );
 for(i=1; i<order-2; i++)
        weights[i] = 1.f/( lsf[i] - lsf[i-1] ) + 1.f/( lsf[i+1] - lsf[i] );
  weights[order-2] = 1.f/( lsf[order-2] - lsf[order-3] ) + 1.f/
  ( 6400 - lsf[order-2] );
 /* Fitting model*/
 for(i=0; i<order-1; i++)
 {
  weights[i] *= (6400/PI);
        weights[i] = ((float)(isf_fit_model[0][i])/(1<<12))
              + weights[i]*((float)(isf_fit_model[1][i])/(1<<14))
              + weights[i]*weights[i]*((float)(isf_fit_model[2][i])/(1<<19))
              + parcorr[0]* ((float)(isf_fit_model[3][i])/(1<<13))
              + parcorr[1] * ((float)(isf_fit_model[4][i])/(1<<10));
   /* avoid too low weights and negative weights*/
   if(weights[i] < 1.f/(i+1))
        weights[i] = 1.f/(i+1);
 }
 if(smooth_flag){
  for(i=0; i<order-1; i++) {
        tmp = 0.75f*weights[i] * 0.25f*w_past[i];
        w_past[i]=weights[i];
        weights[i]=tmp;
  }
 }
weights[order-1]=1;
```

where fitting model coefficients for input signal with frequency components going up to 6.4 kHz:

```
lsf fit model[5][15] = {
        {8112, 7326, 12119, 6264, 6398, 7690, 5676, 4712,
        4776, 3789, 3059, 2908, 2862, 3266, 2740},
        {16517, 13269, 7121, 7291, 4981, 3107, 3031, 2493,
        2000, 1815, 1747, 1477, 1152, 761, 728},
        {-4481, -2819, -1509, -1578, -1065, -378,
        -519, -416, -300, -288, -323, -242, -187, -7, -45},
        {-7787, 5365, 12879, 14908, 12116, 8166, 7215, 6354,
        4981, 5116, 4734, 4435, 4901, 4433, 5088},
        {-11794, 9971, -3548, 1408, 1108, -2119, 2616,
        -1814, 1607, -714, 855, 279, 52, 972, -416}};
```

where fitting model coefficients for input signal with frequency components going up to 4 kHz and with zero energy for frequency component going from 4 to 6.4 kHz:

```
lsf fit model [5][15] = {
        {21229, -746, 11940, 205, 3352, 5645, 3765,
        3275, 3513, 2982, 4812, 4410, 1036, -6623, 6103},
        {15704, 12323, 7411, 7416, 5391, 3658, 3578,
        3027, 2624, 2086, 1686, 1501, 2294, 9648, -6401},
        {-4198, -2228, -1598, -1481, -917, -538, -659,
        -529, -486, -295, -221, -174, -84, -11874, 27397},
        {-29198, 25427, 13679, 26389, 16548, 9738,
        8116, 6058, 3812, 4181, 2296, 2357, 4220, 2977, -71},
        {-16320, 15452, -5600, 3390, 589, -2398, 2453,
        -1999, 1351, -1853, 1628, -1404, 113, -765, -359}};
```

Basically, the orders of the ISF are modified which may be seen when compared the block /* compute IHN weights */ of both pseudo-codes.

Figure 8:
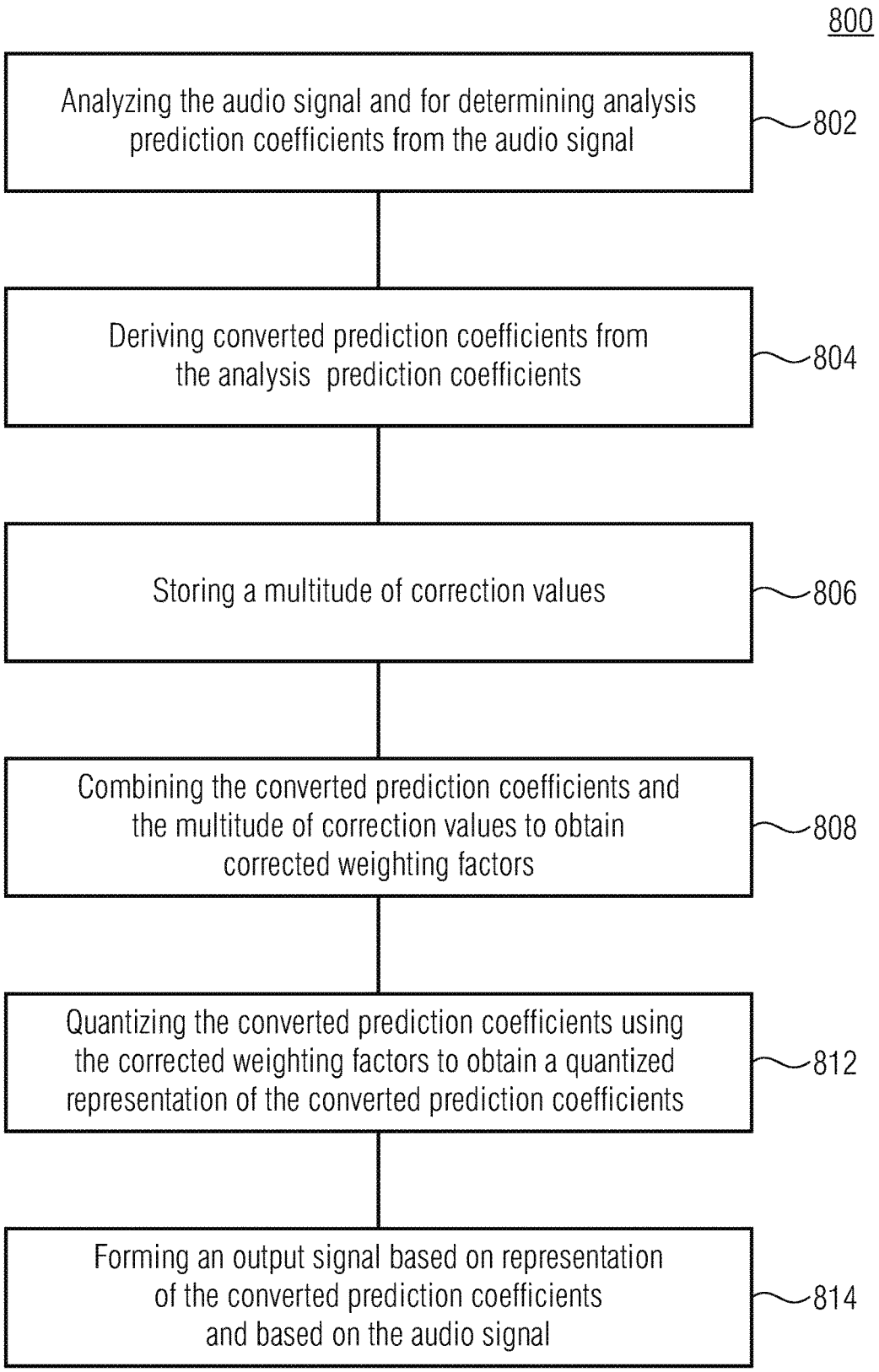
FIG. 8 shows a schematic flowchart of a method for encoding an audio signal according to an embodiment.

FIG. 8 shows a schematic flowchart of a method 800 for encoding an audio signal. The method 800 comprises a step 802 in which the audio signal is analyzed in which analysis prediction coefficients are determined from the audio signal. The method 800 further comprises a step 804 in which converted prediction coefficients are derived from the analysis prediction coefficients. In a step 806 a multitude of correction values is stored, for example in a memory such as the memory 160. In a step 808 the converted prediction coefficients and the multitude of correction values are combined to obtain corrected weighting factors. In a step 812 the converted prediction coefficients are quantized using the corrected weighting factors to obtain a quantized representation of the converted prediction coefficients. In a step 814 an output signal is formed based on representation of the converted prediction coefficients and based on the audio signal.

In other words, the present invention proposes a new efficient way of deriving the optimal weights w by using a low complex heuristic algorithm. An optimization over the IHM weighting is presented that results in less distortion in lower frequencies while giving more distortion to higher frequencies and yielding a less audible the overall distortion. Such an optimization is achieved by computing first the weights as proposed in [1] and then by modifying them in a way to make them very close to the weights which would have been obtained by using the G.718's approach [3]. The second stage consist of a simple second order polynomial model during a training phase by minimizing the average Euclidian distance between the modified IHM weights and the G.718's weights. Simplified, the relationship between IHM and G.718 weights is modeled by a (probably simple) polynomial function.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

LITERATURE

[1] Laroia, R.; Phamdo, N.; Farvardin, N., "Robust and efficient quantization of speech LSP parameters using structured vector quantizers," Acoustics, Speech, and Signal Processing, 1991. ICASSP-91, 1991 International Conference on, vol., no., pp. 641,644 vol. 1, 14-17 Apr. 1991

[2] Gardner, William R.; Rao, B. D., "Theoretical analysis of the high-rate vector quantization of LPC parameters," Speech and Audio Processing, IEEE Transactions on, vol. 3, no. 5, pp. 367,381, September 1995

[3] ITU-T G.718 "Frame error robust narrow-band and wideband embedded variable bit-rate coding of speech and audio from 8-32 kbit/s", June 2008, section 6.8.2.4 "ISF weighting function for frame-end ISF quantization

The invention claimed is:

1. Method for determining correction values for a first multitude of first weighting factors each weighting factor adapted for weighting a portion of an audio signal, the method comprising:

calculating the first multitude of first weighting factors for each audio signal of a set of audio signals and based on a first determination rule;

calculating a second multitude of second weighting factors for each audio signal of the set of audio signals based on a second determination rule, each of the second multitude of weighting factors being related to a first weighting factor;

calculating a third multitude of distance values each distance value having a value related to a distance between a first weighting factor and a second weighting factor related to a portion of the audio signal; and calculating a fourth multitude of correction values adapted to reduce the distance values when combined with the first weighting factors;

wherein the fourth multitude of correction values is determined based on a polynomial fitting comprising multiplying the values of the first weighting factors with a polynomial ($y=a+bx+cx^2$) comprising at least one variable for adapting a term of the polynomial;

storing the fourth multitude of correction values in a memory; and using the fourth multitude of correction values for encoding the audio signal, wherein encoding the audio signal comprises forming an output signal based on a quantized representation of converted prediction coefficients being obtained using the correction values and based on the audio signal;

wherein one or more of calculating the first multitude of first weighting factors, calculating the second multitude of second weighting factors, calculating the third multitude of distance values and calculating the fourth multitude of correction values is performed, at least partially, by one or more hardware elements of an apparatus.

2. Method according to claim 1, wherein the fourth multitude of correction values is determined based on a polynomial fitting comprising:

multiplying the values of the first weighting factors with a polynomial ($y=a+bx+cx^2$) comprising at least one variable for adapting a term of the polynomial;

calculating a value for the variable such that the third multitude of distance values comprises a value below a threshold value based on:

$$\frac{\partial d_i}{\partial P_i} = 2EI_i^T(G - EI_iP_i) = 0$$

and $$P_i = (EI_i^H EI_i)^{-1} EI_i^H G_i$$

wherein $d_i$ denotes a distance value of an i-th portion of the audio signals, wherein $P_i$ denotes a vector comprising a form based on $P_i=[p_{0,i}, p_{1,i}\ p_{2,i}]^T$, and wherein $EI_i$ denotes a matrix based on:

$$EI_i = \begin{bmatrix} 1 & I_{1,i} & I_{1,i}^2 \\ 1 & I_{2,i} & I_{2,i}^2 \\ \vdots & \vdots & \vdots \end{bmatrix}$$

wherein $I_{x,i}$ denotes the i-th weighting factor determined based on the first determination rule for the x-th portion of the audio signal.

3. Method according to claim 1, wherein the third multitude of distance values is calculated based on a further information comprising reflection coefficients or an information related to a power spectrum of the at least one of the set of audio signals based on:

$$EI_i = \begin{bmatrix} 1 & I_{1,i} & I_{1,i}^2 & r_{1,1} & r_{1,2} & \cdots \\ 1 & I_{2,i} & I_{2,i}^2 & r_{2,1} & r_{2,2} & \cdots \\ \vdots & \vdots & \vdots & \vdots & \vdots & \ddots \end{bmatrix},$$

wherein $I_{x,i}$ denotes the i-th weighting factor determined based on the first determination rule for the x-th portion of the audio signal and $r_{a,b}$ denotes the further information based on the b-th weighting factor and the x-th portion of the audio signal.

4. A non-transitory digital storage medium having a computer program stored thereon to perform the method according to claim 1 when said computer program is run by a computer.

* * * * *